United States Patent [19]

Weiss

[11] 4,008,869

[45] Feb. 22, 1977

[54] PREDICTED - CORRECTED PROJECTILE CONTROL SYSTEM

[75] Inventor: Herbert K. Weiss, Palos Verdes Pennisula, Calif.

[73] Assignee: Litton Systems, Inc., Beverly Hills, Calif.

[22] Filed: Jan. 7, 1976

[21] Appl. No.: 647,293

[52] U.S. Cl. ..... 244/3.13

[51] Int. Cl.[2] ..... F42B 15/00; F42B 15/10; F42B 13/30

[58] Field of Search ..... 244/3.13, 3.1

[56] References Cited

UNITED STATES PATENTS

| | | | |
|---|---|---|---|
| 3,604,897 | 9/1971 | McAdam, Jr. | 244/3.1 |
| 3,710,086 | 1/1973 | Lahde et al. | 244/3.1 |
| 3,860,199 | 1/1975 | Dunne | 244/3.13 |
| 3,883,091 | 5/1975 | Schaefer | 244/3.13 |
| 3,900,175 | 8/1975 | Eckerstrom et al. | 244/3.13 |

*Primary Examiner*—Samuel W. Engle
*Assistant Examiner*—Thomas H. Webb
*Attorney, Agent, or Firm*—Donald J. Ellingsberg; Norman E. Brunell

[57] ABSTRACT

A projectile control system for projectile guidance and control for use against moving targets, which allows the projectile to fly a minimum energy path to target intercept, applies corrective commands to the projectile as it approaches the target to correct the projectile in flight for errors in system "boresighting" and similar errors, and also to correct the ground control system on the basis of the same measurements so that these calibration errors will have a reduced degradation on the accuracy of subsequent projectiles, and uses the miss sensing process to improve prediction accuracy when unguided projectiles are fired from the same launcher so that the system has both a controlled projectile and an unguided projectile capablity, and both capabilities benefit from the miss sensing and data processing process.

9 Claims, 4 Drawing Figures

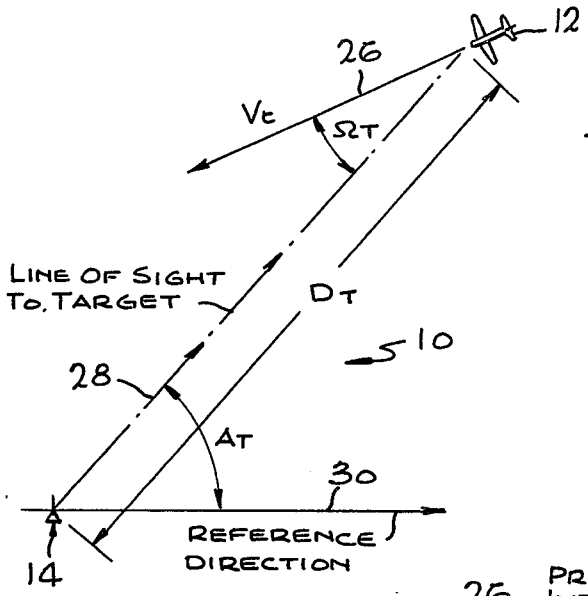
Fig. 1
Fig. 2
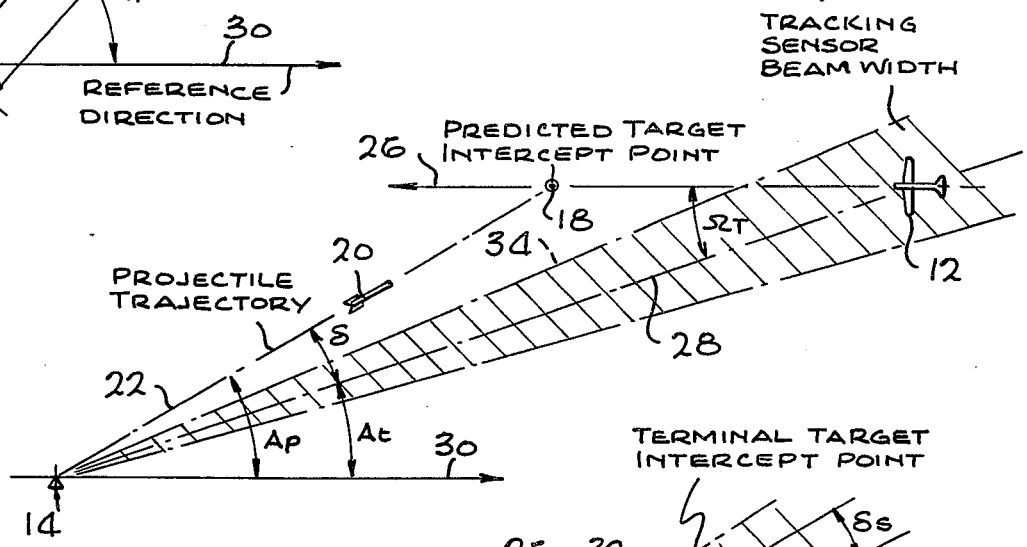
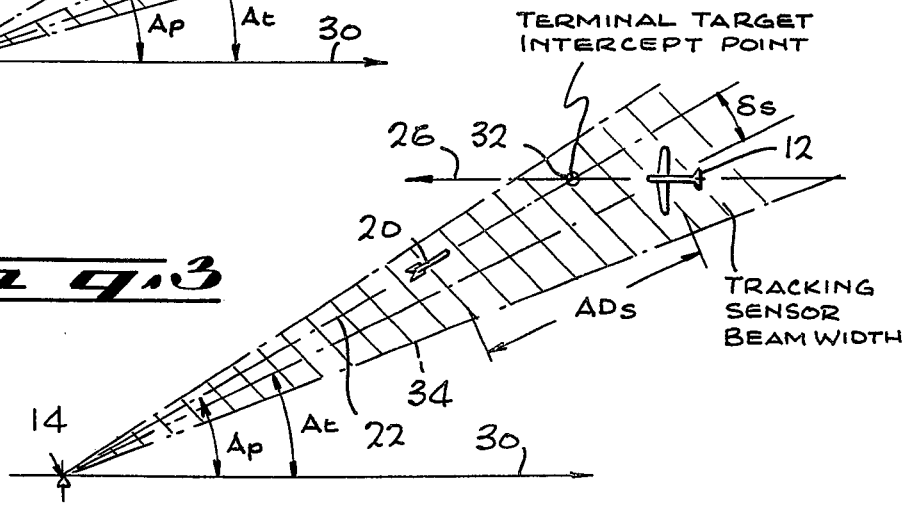
Fig. 3
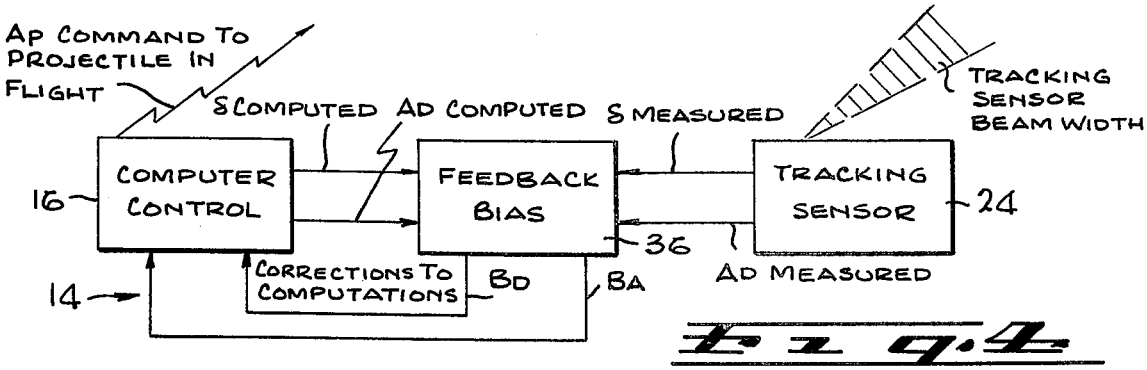
Fig. 4

PREDICTED - CORRECTED PROJECTILE CONTROL SYSTEM

The invention described herein was made in the course of or under a contract or subcontract thereunder with the Department of the Navy.

BACKGROUND OF THE INVENTION

Known projectile systems employ guided missiles flying "minimum energy" trajectories. One radar tracks the target. A second radar tracks the missile. On the basis of these two sets of measurements the missile is commanded to intercept the target. If the two radars are not individually aligned exactly to a common coordinate system, the difference in alignment will appear in a projectile miss component at the target. For example, if this "boresighting" procedure ends up with a 2 mil elevation difference between radars, and there are no other system errors, the missile will miss the target by about 10 meters at 5 km. Range "biases" across radars also contribute to the miss vector, if not removed in radar calibration. Boresighting takes time, must be done repeatedly since radar tends to "drift" off calibration, and requires skilled personnel. It is especially difficult in a mobile field operation where the equipnment is jolted and vibrated during cross country moves. These error sources are probably the reason that recent projectile systems do not employ the minimum energy predicted point type of solution.

Several known projectile systems currently fly "line of sight" trajectories to intercept. The missile positions are measured relative to target position by a single radar, hence there is no "boresight error". However, since the "line of sight" to the target is in motion, the missiles must develop a continuous lateral acceleration to stay on the beam. Acceleration requirements can be as high as 10 g (gravities); the development of lift force of this magnitude requires relatively large lift surfaces, and the drag induced by lift consumes propellant and kinetic energy. Hence these missiles tend to be relatively large, costly, and only rocket propelled vehicles have been feasible. By contrast the energy expenditure to fly a "minimum energy path" is quite small.

Many air defense missiles have homing heads which (1) illuminate the target by radar for the missile and home on the reflected radiation, or (2) illuminate the target from the ground by radar, with missile homing on the reflected radiation, or (3) sense the infrared (IR) radiation of the target and home on it. Radar homing heads are expensive; IR homing heads have difficulty in sensing the target in its forward aspect, and are also expensive.

The concept of measuring the miss vectors of unguided projectiles at the target and using this principle to correct the fire control algorithms has been used in antiaircraft gun systems for decades. Automatic operations of this concept with uncontrolled projectiles is employed by known projectile systems.

There are certain disadvantages in these known projectile control systems where although certain ones fly a minimum energy path, each is vulnerable to boresight errors which could be large and unpredictable in a field mobile installation. Others have eliminated boresight errors, but fly a trajectory that requires hgh energy expenditure. Missiles with homing heads using radar target illumination are costly because of the expense of the homing head. Missiles using IR homing heads have difficulty in sensing the target in the forward aspect and are also costly. Use of miss measurements to correct the fire control system for biases has the disadvantage that the gun-fired projectiles cannot be controlled in flight, hence the system is vulnerable to large errors caused by target maneuvers, as well as being severely limited in maximum range.

OBJECTS OF THE INVENTION

Accordingly, it is an object of the invention to provide a new and improved predicted-corrected projectile control system that eliminates boresight and calibration errors which have been a problem with known predicted beam minimum energy path guided projectiles.

It is an object of the invention to provide a predicted-corrected projectile control system that allows the projectile to fly a minimum energy path so that it expends maneuver energy principally to follow target accelerations, and to a minor degree to adjust its path and make the final system error adjustment.

It is an object of the invention to provide a predicted-corrected projectile control system that, in those cases where the full final correction cannot be made on a projectile in flight, because of insufficient time the inferred system error is processed and the system computations are corrected so that these system errors will be greatly reduced when subsequent projectiles are fired.

It is an object of the invention to provide a predicted-corrected projectile control system that can be used when either controlled or conventional uncontrolled projectiles are fired; hence the more expensive controlled projectiles can be fired at medium to long ranges, and inexpensive conventional projectiles can be fired at short ranges where accuracy requirements are less.

It is an object of the invention to provide a predicted-corrected projectile control system that minimizes the equipment on-board the projectile such that the minimal on-board guidance-and-control equipment plus the low energy expenditure for control allows the projectile weight and size to be reduced to a degree that gun fired controlled projectiles without in-flight propulsion are feasible, and similarly, conventional rocket-powered guided projectiles can be fabricated which are lighter and smaller than existing missiles of comparable capability.

SUMMARY OF THE INVENTION

Briefly, in accordance with the invention, a new and improved projectile control system is provided where projectile such as a missile follows a determinable minimum energy path to an intercept point with a selected target. The projectile control system has a tracking sensor means continuously tracking the selected target by a sensor beam having a determinable finite dimension and generating a target signal corresponding at least to the azimuth and range of the tracked target; the tracking sensor means further terminally tracking both the missile and target within the sensor beam and further generating a missile signal corresponding at least to the azimuth and range of the terminally tracked missile. A control means responsive to the target signal generates a ballistic data signal for the missile so that the missile, having an independent flight control system responsive to internally stored ballistic data and to the ballistic data signal, is deployed along a minimum energy path to an initial target intercept. A feedback means responsive both to the target signal and the missile signal and further to the ballistic data signal generates a bias signal for the control means. The control means is further responsive to the bias signal and generates a corrected ballistic data signal for the missile so that the missile is continuously adjusted in flight to follow the minimum energy path to a terminal target intercept when the tracking sensor means tracks both the selected target and the missile.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

BRIEF DESCRIPTION OF THE DRAWING

FIG. 1 is a schematic diagram of the predicted-corrected projectile control system of the invention in a first stage of operation.

FIG. 2 is a schematic diagram of the predicted-corrected projectile control system of the invention in a second stage of operation.

FIG. 3 is a schematic diagram of the predicted-corrected projectile control system of the invention in a third stage of operation prior to target intercept.

FIG. 4 is a schematic block diagram of the predicted-corrected projectile control system of the invention. application for

DESCRIPTION OF THE INVENTION

The pedicted-corrected projectile control of 10 of the present invention can be used against rapidly moving ground targets as well as aerial targets. However, the aerial problem is considered to be more difficult and the following description will use the air defense application for clarity of illustration.

In the projectile control system 10, an aerial target 12, such as an aircraft, helicopter, stand-off missile, is tracked by a ground station 14, and its track is extrapolated forward in time by conventional techniques for predicted fire systems. A computer control 16 (see FIG. 4) determines a predicted intercept point 18 (see FIG. 2) using trajectory data for the weapon to be fired, and a projectile 20 is fired at that point. The computation includes the effect of gravity, wind, etc. and the projectile launch angles are computed such that in an ideal case the projectile 20 would fly a minimum energy path 22 to the predicted intercept point 18. This minimum energy path 22 is simply the path that would be flown by a gun launched projectile or unguided rocket in a normal antiaircraft fire, since neither of these projectiles expends in flight except against aerodynamic drag.

The projectile 20 used in the present invention may be (1) a gun launched projectile without propulsive source in flight, (2) a gun launched projectile with rocket propulsion in flight, or (3) a rocket deriving all of its velocity from rocket propulsion.

In the projectile control system 10, once the projectile 20 is in flight, its trajectory is controlled by either:

a. tracking the projectile with a tracking sensor 24 (see FIG. 4) in angle and range and commanding trajectory adjustments via a command link, or b. controlling the position of a guide beam to which the projectile is self-commanded by known "beam riding" techniques.

In either case, the trajectory of the projectile 20 is adjusted according to continual updating and refinement of the predicted point of intercept 18 derived from the tracking sensor 24, which can be radar, and processed by the computer control 16. As the projectile 20 nears the target 12, the "lead angle" between target position and projectile position will collapse to zero within the limits of system accuracy.

Moreover, if the target 12 maneuvers while the projectile 20 is in flight, the predicted intercept point 18, is adjusted correspondingly. The maximum acceleration required of the projectile 20 to follow this adjustment never exceeds that employed by the target 12 in maneuver, although a small margin of acceleration superiority by the projectile will guard against its lagging the target as a result of control system lags.

The projectile control system 10 described in more detail hereinafter avoids the disadvantages of known control systems by utilizing simultaneous sensings of the projectile 20 and the target 12 when the projectile nears the target (terminal phase of intercept). The tracking sensor 24 senses both target 12 and projectile 20 simultaneously when the edge of the tracking sensor beam 34 intercepts the projectile's trajectory 22. At this point, the tracking sensor 24 is able to measure the angular and range position of the projectile 20 relative to the target 12. These differential measurements are transmitted to the computer control 16, which compares these measurements against the quantities internally computed for projectile control. Boresight errors, calibration errors and other biases will appear as differences between the two sets of measurements. The system then:

a. commands the projectile in flight to adjust its trajectory to eliminate the observed errors (depending on the intercept geometry, the time available to make this correction may vary from a fraction of a second to several seconds), and b. inserts the derived correction to the computational process so that the observed biases will have been removed when subsequent projectiles are fired.

For clarity of further description, consider the intercept process taking place in the plane of the drawing. This simplifies the description, but does not minimize any of the essential elements of the projectile control system 10. The target path 26 and the projectile trajectory 22 are both assumed to be straight lines; inclusion of target path curvature and projectile gravity drop would not change the description of operation.

FIG. 1 shows the geometric relationship of the target 12 to the ground station fire unit 14. A tracking sensor 24, such as radar, continuously measures range $D_t$ and azimuth $A_t$ of the target 12. Azimuth track 28 is measured relative to a reference direction 30 such as North. Because of imperfect system boresighting and calibration, both measurements may be in error by a constant amount designated "biases".

From this tracking information, and internally stored ballistic data on the projectile 20, a computer control 16 determines a predicted target intercept point 18 for the projectile. The projectile is fired at the computed azimuth $A_p$ of this point, along a minimum energy trajectory 22, which is a straight line as previously noted.

FIG. 2 shows the projectile 20 in flight. The computer control 16 determines the firing azimuth $A_p$ by adding a lead angle $\delta$ to $A_t$. It computes $\delta$ continuously while the projectile is in flight, and as the projectile approaches the target 12, $\delta$ should become zero at terminal target intercept 32. The projectile in flight is commanded to follow this continuously updated estimate of $A_p$.

The rate of change of the angle $\Omega_t$ shown in FIG. 2, and rate of change of range to the target $D_t$ are $$\Omega_t = v_t \sin \Omega_t / D_t$$

$$\dot{D}_t = -V_t \cos \Omega_t$$

and $$\dot{\Omega}_t = \dot{A}_t$$

If these quantities are measured without error, the computed time to intercept is $$t_a = -(D_t - D_p)/D_r$$

where $D_p$ = range of the projectile from the fire unit, and $D_r$ is the rate of change of range difference between projectile and target, $$\dot{D}_r = -(v_p + v_t \cos \Omega_t)$$

where $v_p$ is the remaining velocity of the projectile.

The correct lead angle $\Omega^*$, which becomes zero when $D_p = D_t$, $$\Omega^* = \dot{\Omega}_t \, t_a$$

$$\delta^* = \frac{(v_t/v_p) \sin \Omega_t}{1 + (v_t/v_m) \cos \Omega_t} [1 - (D_p/D_t)]$$

In FIG. 2, the sensor beam 34, defined by the phantom lines, tracks the target 12 and is shown to have a finite beam width. However, in this initial phase of the intercept process, the projectile 20 lies outside the beam. As the target moves forward toward terminal target intercept 32, the sensor beam 34, which initially includes only the target tracking, eventually includes the projectile 20 as shown in FIG. 3. At this time, the tracking sensor 24 is able to measure directly the angle $\delta_s$ relative to the target 12 and the range difference $\Delta D_s$ of projectile to target where the subscript $s$ denotes "sensed" as opposed to "computed". Both of these measures will be changing with time, and depending on the implementation of the invention, may be obtained as a single pair at a range short of intercept, or as multiple or continuous measurements over a brief time interval.

The computer control 16 has its own estimates of angle $\delta$ and $\Delta D$, on the basis of which it has been directing the projectile 20. Hence, these can be compared against the measured values, and differences obtained as both target 12 and projectile 20 are simultaneously tracked by the sensor beam 34, or at a single observation point if a range gate short of the target is employed to simplify the sensor package and data processing. In general, multiple or continuous measurements are desirable to reduce measurement errors, but the system projectile control 10 is operative on a single pair of measurements.

In general, both the target tracking sensor 24 and the directing beam or projectile tracking sensor of the computer control 16, depending on configuration, will be imperfectly calibrated and aligned, so that there will be a net azimuth bias error $B_A$ and a new range bias error $B_D$ between them.

Then the computer control 16 will have computed $$\delta_{comp} = \delta^* [1 + (B_D/\Delta D] = B_A$$

and $$\Delta_{comp} = \Delta D + B_D$$

From these expressions, the biases can be extracted by a feedback bias unit 36 as $$B_D = \Delta D_{computed} - \Delta D_{sensed}$$

$$B_A = \delta_{computed} - \delta_{sensed}(\Delta D_{computed}/\Delta D_{sensed})$$

The data flow is shwon in FIG. 4.

These bias estimates from the feedback bias unit 36 are fed into the computer control 16, to correct future computations. The command azimuth $A_p$ from the computer control 16 to projectile 20 is simultaneously adjusted to $$A_p^* = (A_p)_{computed} - B_A$$

and, if sufficient time remains before terminal target intercept 32, the projectile with change its path 22 accordingly and hit the target 12.

Since the measured bias corrections have been entered into the computer control 16, computations for subsequent projectiles can be done without the undesirable and unwanted bias errors.

It will be understood that in the three-dimensional case, the computational processes will be more complex than for the plane case as described herein before.

In the event that a tracking sensor 24 is used in the projectile control system 10 which can only make a single miss measurement on the projectile 20; for example, as the projectile passes through a range gate short of the target 12, the method of operation of the system 10 will be similar to that described hereinbefore. However, there will be a single pair of measurements of $\delta_s$ & $\Delta D_s$ on which to base the correction instead of a continuous set for an extended time duration.

It is contemplated that certain alternatives in implementing the invention as described depend on the choice of the method of commanding the projectile, either track and command or provide a guide beam, or the launch unit/projectile combination; for example, gun-fired unboosted projectile; gun-fired boosted projectile; or, rocket-propelled projectile without gun boost. The operational characteristics for target miss sensing, correction command, and correction of the prediction process would be identical in any of these applications.

Further, system operation may be based on (1) a single projectile/target relative position sensing as by a range gate short of the target, or (2) by several or continuous sensings while both projectile and target are in the target tracking sensor beam.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart from the true spirit and scope of the invention.

I claim:

1. A projectile control system where the projectile follows a determinable minimum energy path to an intercept point with a selected target, the projectile control system comprising:

a. first means for continuously tracking the selected target by a sensor beam having a determinable finite dimension and for generating a first means target signal corresponding at least to the azimuth and range of said tracked target, b. said first means further being for terminally tracking both the projectile and target within said sensor beam and further for generating a first means projectile signal corresponding at least to the azimuth and range of said terminally tracked projectile, c. second means responsive to said first means target signal for generating a ballistic data signal for the projectile so that the projectile, having an independent flight control system responsive to internally stored ballistic data and to said ballistic data signal, is deployed along a minimum energy path to an initial target intercept, and d. third means responsive both to said first means target signal and first means projectile signal and to said ballistic data signal for generating a bias signal for said second means, d. said second means being further responsive to said bias signal for generating a corrected ballistic data signal for the projectile so that the projectile is continuously adjusted in flight to follow the minimum energy path to a terminal target intercept when said first means tracks both the selected target and the projectile.

2. The projectile control system of claim 1 in which said first means is a tracking sensor.

3. The projectile control system of claim 2 in which said tracking sensor during said terminal tracking measures range $D_t$ and azimuth $A_t$ of said target and range $D_p$ and azimuth $A_p$ of said projectile.

4. The projectile control system of claim 2 in which said tracking sensor is a radar unit.

5. The projectile control system of claim 1 in which said second means is a computer control unit.

6. The projectile control system of claim 5 in which said computer control unit continuously adjusts said ballistic data signal as the projectile approaches the target.

7. The projectile control system of claim 1 in which said first means and said second means have a net range bias error $B_D$ and a net azimuth bias error $B_A$ between said first and second means.

8. The projectile control system of claim 7 in which said third means is further responsive to said bias error $B_D$ and $B_A$ in generating said bias signal.

9. The projectile control system of claim 8 in which said third means is a feedback bias unit.

* * * * *